US009430904B2

(12) United States Patent
Larsen

(10) Patent No.: US 9,430,904 B2
(45) **Date of Patent: *Aug. 30, 2016**

(54) SELF CONFIGURING PROGRESSIVE JACKPOT AWARD CONTROLLER

(71) Applicant: Bally Gaming, Inc., Las Vegas, NV (US)

(72) Inventor: Joshua D. Larsen, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 238 days.

This patent is subject to a terminal disclaimer.

(21) Appl. No.: 14/248,990

(22) Filed: Apr. 9, 2014

(65) Prior Publication Data

US 2014/0228107 A1 Aug. 14, 2014

Related U.S. Application Data

(63) Continuation of application No. 13/751,910, filed on Jan. 28, 2013, now Pat. No. 8,777,736, which is a continuation of application No. 12/828,095, filed on Jun. 30, 2010, now Pat. No. 8,371,934.

(51) Int. Cl.
*A63F 9/24* (2006.01)
*G07F 17/32* (2006.01)

(52) U.S. Cl.
CPC ..... *G07F 17/3258* (2013.01); *G07F 17/3227* (2013.01)

(58) Field of Classification Search
USPC ..... 463/15–27, 40–42
See application file for complete search history.

(56) References Cited

U.S. PATENT DOCUMENTS 2,828,502 A * 4/1958 Tupper ..... A47L 17/00 15/121
7,744,462 B2 * 6/2010 Grav ..... G07F 17/3258 463/27
8,313,382 B2 * 11/2012 Ward ..... G07F 17/323 463/16
2006/0211493 A1 * 9/2006 Walker ..... G06Q 30/02 463/29
2009/0124375 A1 * 5/2009 Patel ..... G07F 17/323 463/29
2009/0253483 A1 * 10/2009 Pacey ..... G07F 17/32 463/20
2009/0291732 A1 * 11/2009 Lutnick ..... G07F 17/32 463/16
2009/0291755 A1 * 11/2009 Walker ..... G06Q 30/02 463/29
2009/0293898 A1 * 12/2009 Young ..... A45D 44/00 132/200
2010/0120538 A1 * 5/2010 DeWitt ..... G07F 17/32 463/42

* cited by examiner

*Primary Examiner* — Masud Ahmed
(74) *Attorney, Agent, or Firm* — Philip J. Anderson; Marvin A. Hein

(57) ABSTRACT

A self configuring progressive jackpot award system includes a plurality of electronic gaming machines (EGMs). The plurality of EGMs respectively include a plurality of EGM configuration options, and operate in accordance with the EGM configuration options. A subset of the plurality of EGM configuration options relates to participating in a progressive jackpot award game. A progressive controller is coupled to the plurality of EGMs and controls the operation of a progressive jackpot award game. The progressive controller includes a plurality of progressive jackpot award game configuration options. A subset of these progressive jackpot award game configuration options correspond to the subset of EGM configuration options related to participating in the progressive jackpot award game. The progressive controller automatically sends data representing this subset of progressive jackpot award game configuration options to the plurality of EGMs. The plurality of EGMs receives the progressive jackpot award game configuration option representative data from the progressive controller, stores the subset of EGM configuration options related to participating in the progressive jackpot award game represented by the data, and participates in the progressive jackpot award game in accordance with the EGM progressive jackpot award game configuration award game options.

9 Claims, 7 Drawing Sheets

SELF CONFIGURING PROGRESSIVE JACKPOT AWARD CONTROLLER

CROSS REFERENCE TO RELATED APPLICATIONS

This application is a continuation of U.S. patent application Ser. No. 13/751,910 filed Jan. 28, 2013 entitled "Self Configuring Progressive Jackpot Award System" which is a continuation of U.S. patent application Ser. No. 12/828,095 titled "Self Configuring Progressive Jackpot Award System" filed Jun. 30, 2010, now U.S. Pat. No. 8,371,934 issued Feb. 12, 2013 and are incorporated herein by reference.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

The present invention relates to configuration of a plurality of electronic EGMs (EGMs) in a networked casino environment, and specifically to a system for automatically configuring and monitoring the configuration of EGMs for participation in a progressive jackpot award system.

BACKGROUND OF THE INVENTION

Existing EGMs are flexible, and may operate in a variety of modes. For example, some EGMs may play any of a number of available game themes, or with different denominations, or with different number of pay lines, etc. In addition, external operational aspects of an EGM may also be adjusted, such as the volume of the sound, etc. These options are specified by configuring the EGM, and the configuration of the EGM is performed by providing data representing the configuration options to the EGM. This may be done through the EGM itself presenting a user interface, and more usually a graphical user interface (GUI), for the user to set, review and revise configuration options, or through attaching an external device to the EGM, such as a laptop computer or handheld personal digital assistant (PDA) device, and interacting with the EGM using that device to set, review and revise configuration options.

It is also known to arrange EGMs in a network including other EGMs and one, or typically more than one, central servers. In existing arrangements, current configuration options of the respective EGMs may be read by a central server, and may also be set and revised from that central server. Typically, an employee manually prepares a set of changes for one or more EGMs, termed a job. This job is reviewed and approved by one or more other employees. If approved, this set of changes is supplied to the central server, which prepares data representing the desired change in configuration options of the EGMs. At the appropriate time, data is transferred among the EGMs and the central server, updating the EGM configuration options as desired.

EGMs may also participate in known progressive jackpot award systems. Such systems are controlled by a progressive controller, which is one of the central servers in the network. The progressive controller is also flexible and may have different options, such as which EGMs are participating in the progressive jackpot award game, how much of each wager on the EGMs is set aside to increase the progressive jackpot, how much of each wager on the EGMs is set aside to for reseeding the progressive jackpot when that award is won by a player, etc. As with EGMs, data representing the progressive controller options may be entered, reviewed and updated through the progressive controller itself presenting a GUI for the user to set configuration options, or through attaching an external device to the progressive controller.

The configuration of both the progressive controller and the EGMs participating in the progressive jackpot award game affect the operation of the progressive jackpot award game. Properly configuring EGMs participating in a progressive jackpot award system is very important. This is especially true as progressive jackpot award systems become more complicated, and EGMs become more flexible. For example, some progressive jackpot award systems have been designed to operate with a set of EGMs concurrently configured to present respectively different game titles, paytables, and denominations. An error in configuring such EGMs may lead to incorrect progressive payout amounts and frequencies at the EGMs.

However, at present, the respective EGMs participating in progressive jackpot award systems are manually configured, either at the EGM itself, or remotely from a central server (typically not the progressive controller) as described above. This can lead to errors in configuration and take hours for the operator to configure and verify. In addition, manual configuration of EGMs in a progressive jackpot award system is subject to an operator cheating by intentionally misconfiguring EGMs.

A system for ensuring that EGMs participating in a progressive jackpot award system are properly configured is desirable. It is further desirable that the configuration is performed in a manner which lessens the possibility of operator error or cheating, and minimizes the time required to configure the EGMs.

BRIEF DESCRIPTION OF THE INVENTION

In accordance with principles of the present invention, a self configuring progressive jackpot award system includes a plurality of electronic gaming machines (EGMs). The plurality of EGMs respectively include a plurality of EGM configuration options, and operate in accordance with the EGM configuration options. A subset of the plurality of EGM configuration options relates to participating in a progressive jackpot award game. A progressive controller is coupled to the plurality of EGMs and controls the operation of a progressive jackpot award game. The progressive controller includes a plurality of progressive jackpot award game configuration options. A subset of these progressive jackpot award game configuration options correspond to the subset of EGM configuration options related to participating in the progressive jackpot award game. The progressive controller automatically sends data representing this subset of progressive jackpot award game configuration options to the plurality of EGMs. The plurality of EGMs receives the progressive jackpot award game configuration option representative data from the progressive controller, stores the subset of EGM configuration options related to participating in the progressive jackpot award game represented by the data, and participates in the progressive jackpot award game in accordance with the EGM progressive jackpot award game configuration options.

DETAILED DESCRIPTION

Figure 1:
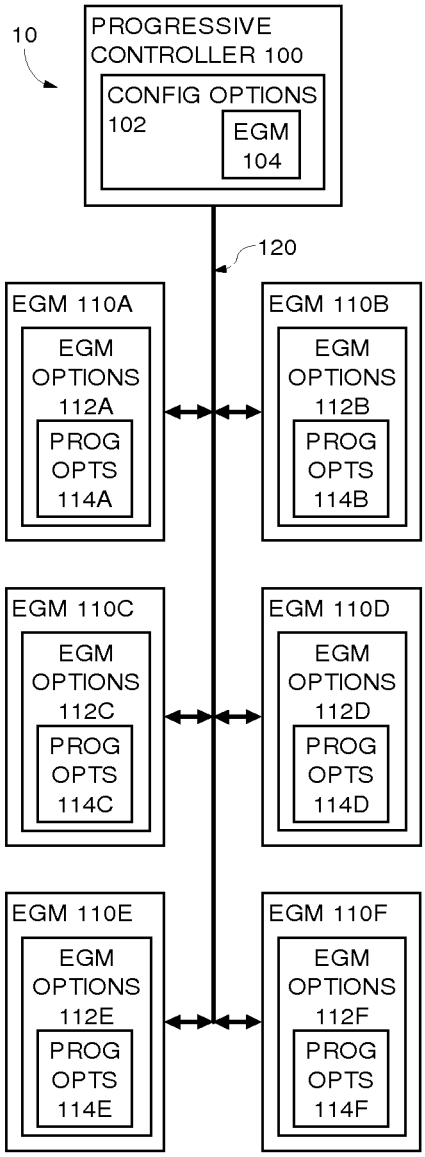
FIG. 1 is a block diagram of a self configuring progressive jackpot award system according to principles of the present invention.
Figure 2:
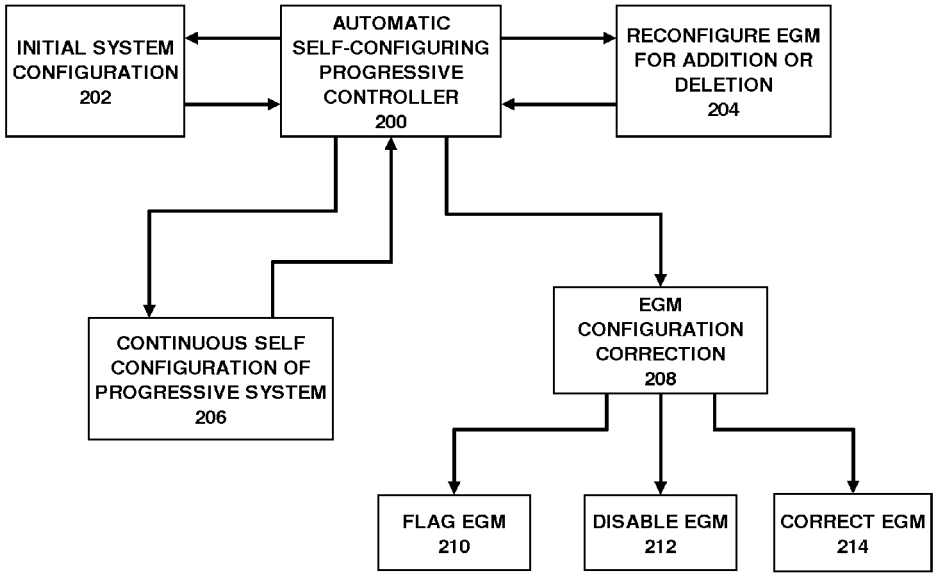
FIG. 2 is a flow chart helpful in understanding the operation of the self configuring progressive jackpot award system illustrated in FIG. 1.

FIG. 1 is a block diagram of a self configuring progressive jackpot award system 10 according to principles of the present invention and FIG. 2 is a flow chart helpful in understanding the operation of the self configuring progressive jackpot award system illustrated in—FIG. 1. In FIG. 1, a progressive controller 100 is coupled to a plurality of electronic EGMs 110A to 110F via a communication link 120. One skilled in the art understands that the communication link 120 may be a plurality of connections between the progressive controller 100 and the respective EGMs 110A-F. Alternatively the communications link 120 may be a network connection including one or more of a gaming area network, local area network (LAN), and/or wide area network (WAN) which may include the Internet. In this case, one skilled in the art understands that one or more pieces of communication equipment (not shown), such as routers, switches, hubs, communication concentrators, etc. are included in the communications link 120, and understands how to design, implement and interact with such a network.

The progressive controller 100 includes data 102 representing progressive jackpot configuration options. A subset 104 of this configuration option representative data is data representing configuration options for EGMs which participate in this progressive jackpot award game. Similarly, the EGMs 110A-F include respective data 112A-F representing EGM configuration options. At least a portion 114A-F of the EGM configuration option representative data 112A-F is data representing EGM configuration options related to the participating in the progressive jackpot award game.

In operation, referring to FIG. 2, the progressive jackpot award system begins operation in block 200. In an example, the EGMs 110A-F may be configured to operate as standalone EGMs in a known manner. For example, the game theme, denomination, paytable, etc. may be specified by a user for the respective EGMs 110A-F. As described above, this may be done by accessing a GUI generated by the EGM itself, or by attaching an external device to the EGM and using a GUI generated by the external device, or by a remote device such as a central server. In this configuration, EGM configuration options related to participation in the progressive jackpot award game may be left unset. In any event, they are ignored by the EGMs 110A-F because they are not participating in a progressive jackpot award game.

The progressive controller 100 may also be configured, as described above, to operate a progressive jackpot award game as desired. This configuration process results in generating data 102 representing the configuration options necessary to define and operate the desired progressive jackpot award game. The subset 104 of configuration option representative data in the EGMs 110 specifies configuration options required for the EGMs. This data may be in the form of specific data for corresponding configuration options in the EGM, or it may be in the form of rules which govern relationships among different configuration options.

For example, a progressive jackpot award game may be configured to operate with EGMs of a single specified denomination, e.g. $1. In this case, configuration option representative data setting the denomination of the EGMs participating in the progressive jackpot award game to $1 may be sent from the progressive controller 100 to the EGMs 110A-F via the communications link 120. In another example, a progressive jackpot award game may be configured to operate with games of different denominations: $0.25, $0.50, and $1. In this case configuration data representing a rule specifying this range of denominations may be generated. The denomination configuration option of the EGMs participating in the progressive jackpot award game is checked to ensure it is within this range. If not, then the denomination configuration option of that EGM is automatically changed by the progressive controller 100 to be set to one of these denominations, or possibly to be selectable by a player from within this range.

As described above, EGM configuration option data 104 may be in the form of rules. These rules may involve joint specification of more than one configuration option, or conditional specification of a configuration option based on the value of one or more other configuration options. For example, if an EGM denomination is set to $0.25, then the percent of each wager at that EGM which is provided to the progressive controller for the progressive jackpot award game is set to a higher level than for an EGM which is set to a denomination of $1. Such rules permit EGMs which are configured to operate with different configuration options to still be configured properly to operate with the progressive jackpot award game.

When the configuration options 102 for the progressive controller 100 have been successfully specified in the progressive controller 100, the data 104 representing the corresponding appropriate EGM configuration options 114A-F for the EGMs 110A-F may be generated. Referring now to FIG. 2, the progressive controller 10 automatically communicates data representing the initial progressive jackpot award game configuration options to respective ones of the EGMs 110A-F via the communication link 120 as illustrated in block 202. One skilled in the art understands that prior to communicating the progressive jackpot award game configuration option data to the EGMs, the progressive controller 100 may notify an operator to get confirmation or approval for the data transfer.

One skilled in the art understands that the configuration option representative data may be sent from the progressive controller 100 to the EGMs 110A-F using an appropriate data transfer protocol. Several such protocols exist. One such example is the Game-to-System (G2S) protocol accepted by the Gaming Standards Association (GSA). Another example is the Multi-Area Progressive System (MAPS) Multi-Link (MML) protocol developed by Bally Technology. These or any suitable data transport protocol may be used to carry the configuration option representative data from the progressive controller 100 to the EGMs 110A-F.

The EGMs 110A-F receive the progressive jackpot award game configuration representative data from the progressive controller 100 and set the progressive jackpot award game configuration options 114A-F as specified in the received data. The progressive controller 100 may then enable operation of the progressive jackpot award game in the EGMs 110A-F. The progressive jackpot award game operates, in accordance with the configuration options in the progressive controller 100 and the EGMs 110A-F in the known manner.

Because the EGM configuration options 114A-F are generated in the progressive controller 100 and automatically sent to the EGMs 110A-F via the communications link 120, the chance of a misconfiguration of an EGM 110A-F is minimized. In addition, because an employee does not need to access each EGM 110A-F separately, the time required to configure the EGMs 110A-F is greatly reduced, and the chance of a deliberate misconfiguration of an EGM 110A-F is minimized.

In another embodiment, instead of automatically updating the progressive jackpot award game configuration options 114A-F in the EGMs 110A-F, the progressive controller 100 may, instead, request data representing the EGM progressive jackpot award game configuration options 114A-F from the EGMs 110A-F. The progressive controller 100 may compare the received progressive jackpot award game configuration options 114A-F to the subset of progressive jackpot award game configuration options 104 in the progressive controller 100. If they do not correspond, the progressive controller 100 detects an error. In response to a detected error, the progressive controller 100 may flag the EGM and not permit that EGM to participate in the progressive jackpot award game. Alternatively, the progressive controller 100 may disable the EGM and consequently it cannot participate in the progressive jackpot award game.

The example described above configures the EGMs 110A-F in the situation where the EGMs are already configured and operating and the operator wants to enable a progressive jackpot award game. In this case, the progressive controller 100 requests and receives data representing the current configuration of the respective EGMs 110A-F. More specifically, the EGM game theme and denomination are requested and received by the progressive controller 100 from the EGMs 110A-F. As described above, this has already been set either at the EGM or remotely from a central server FIG. 2: block 202). The progressive controller then configures the EGMs 110A-F to be identical to, or compatible with the progressive jackpot award game being configured. If an EGM cannot be configured properly, that EGM is flagged (FIG. 2: block 202 and that EGM is not permitted to participate in the progressive jackpot award game. Alternatively, that EGM may be disabled (FIG. 2: block 202 and consequently not permitted to participate in the progressive jackpot award game.

Referring now to FIG. 2: block 204, this progressive jackpot award system described above may be used to expand an existing progressive jackpot award game. For example, an operator may have six EGMs 110A-F participating in a progressive jackpot award game, and wants to add more EGMs (not illustrated) to participate. The newly added EGMs are assigned to the pre-existing progressive pool as controlled by the progressive controller 100. The progressive controller may configure the EGMs to be newly added to match the other EGMs already participating in the progressive jackpot award game. As described above, the newly added EGMs may be configured identically to the EGMs already participating in the progressive jackpot award game, or they may be configured differently, yet compatibly with the EGMs already participating in the progressive jackpot award game. That is, the newly added EGMs may be configured to run different game themes, or different denominations from the EGMs already participating. It is also possible to delete EGMs from participating in the progressive jackpot award game by sending configuration option representative data removing progressive jackpot award game configuration options from the EGM.

Referring now to FIG. 2, block 208, in an enhanced embodiment, if an EGM is not configured properly to participate in a progressive jackpot award game, instead of flagging or disabling the EGM and preventing it from participating in the progressive jackpot award game, the configuration of that EGM may be automatically corrected by the progressive controller 100. For example, the EGM may be configured for denominations of $0.01, $0.05, and $0.10, but the progressive jackpot award game may be configured to operate only with EGMs configured for denominations of $0.01 and $0.05. In this case, (FIG. 2, block 214) the progressive controller 100 transmits configuration option representative data to the EGM conditioning the EGM to disable the $0.10 denomination and leave the $0.01 and $0.05 denominations playable. If the operator subsequently sets up a progressive jackpot award game for a $0.10 denomination, then the progressive controller 100 sends configuration option representative data to the EGM conditioning it to make $0.10 denomination playable in the progressive jackpot award game.

The progressive jackpot award system described above may operate in a batch mode, in the manner described. For example, an operator may have a plurality of EGMs 110A-F participating in a progressive jackpot award game, but wants to add additional denominations in the EGMs 110A-F participating in the progressive jackpot award game. The progressive controller 100 may generate and communicate data representing configuration options enabling the desired new denominations to all the EGMs 110A-F currently participating in the progressive jackpot award game. In response to this data, all the EGMs 110A-F update their configuration options to enable the new denominations. Consequently there is no requirement to update the respective EGMs 110A-F separately. Similarly, a bank of EGMs 110A-F not currently participating in a progressive jackpot award game may be concurrently and automatically configured properly to participate in the desired progressive jackpot award game, as described above.

Referring now to FIG. 2, block 206, in another enhanced embodiment, the progressive controller 100 monitors the EGM configuration options of the EGMs 110A-F participating in the progressive jackpot award game. This may be done by the progressive controller 100 requesting the current EGM at lease a subset of the configuration options currently set in the EGMs 110A-F. These requests may be repeated at fixed time intervals; or at random intervals according to a probability distribution; or may occur in response to events, or may be triggered by a user manually. One skilled in the art understands how to implement any or all of these functions, and how to determine which is appropriate according to current circumstances.

The EGMs 110A-F respond by sending data representing the requested EGM configuration options 114A-F to the progressive controller 100 via the communications link 120. The progressive controller 100 analyzes the current EGM configuration options to ensure they are within proper limits. If they are not, the EGM configuration may be corrected (FIG. 2, block 208). The EGMs found to be operating outside of proper configuration option limits may be flagged and made unable to participate in the progressive jackpot award game (FIG. 2, block 210); may be disabled and consequently unable to participate in the progressive jackpot award game (FIG. 2, block 212); or the configuration option or options which are not proper may be corrected to the proper option or within the proper range for that option (FIG. 2, block 214).

In addition to monitoring the EGM configuration options 114A-F to detect changes, the progressive controller 100 may also monitor the EGMs to detect reset conditions. For example, when the non-volatile read-write memory (NVRAM) is reset, the progressive controller 100 may detect this condition. In response to detecting a reset condition, the progressive controller 100 may set the EGM to an initial post-reset configuration by sending data representing desired configuration options to the reset EGM. The reset EGM may receive the configuration option representative data and update the configuration options 112A-F accordingly.

Figure 3A:
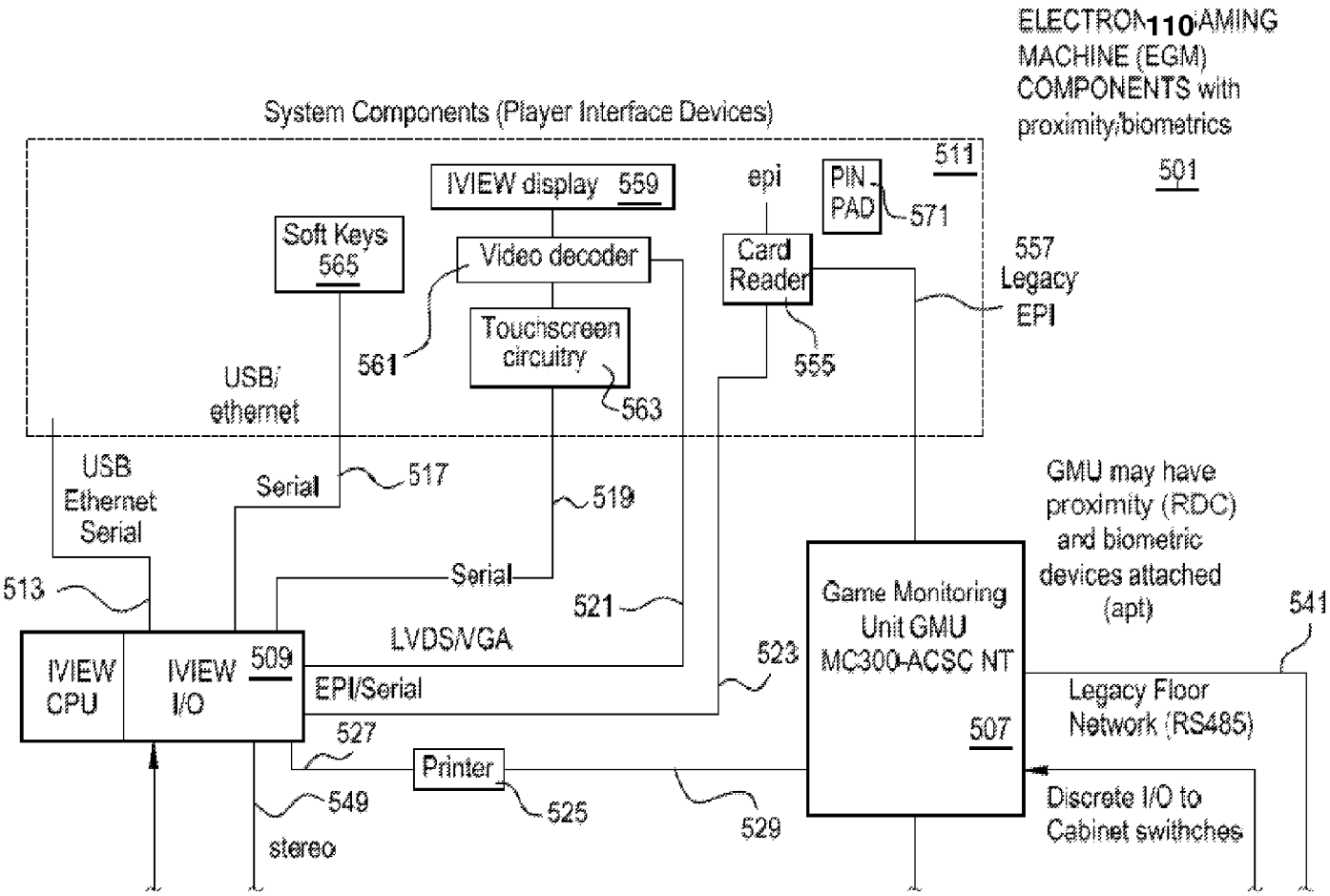
FIGS. 3A and B are block diagrams illustrating an electronic gaming machine according to principles of the present invention.
Figure 3B:
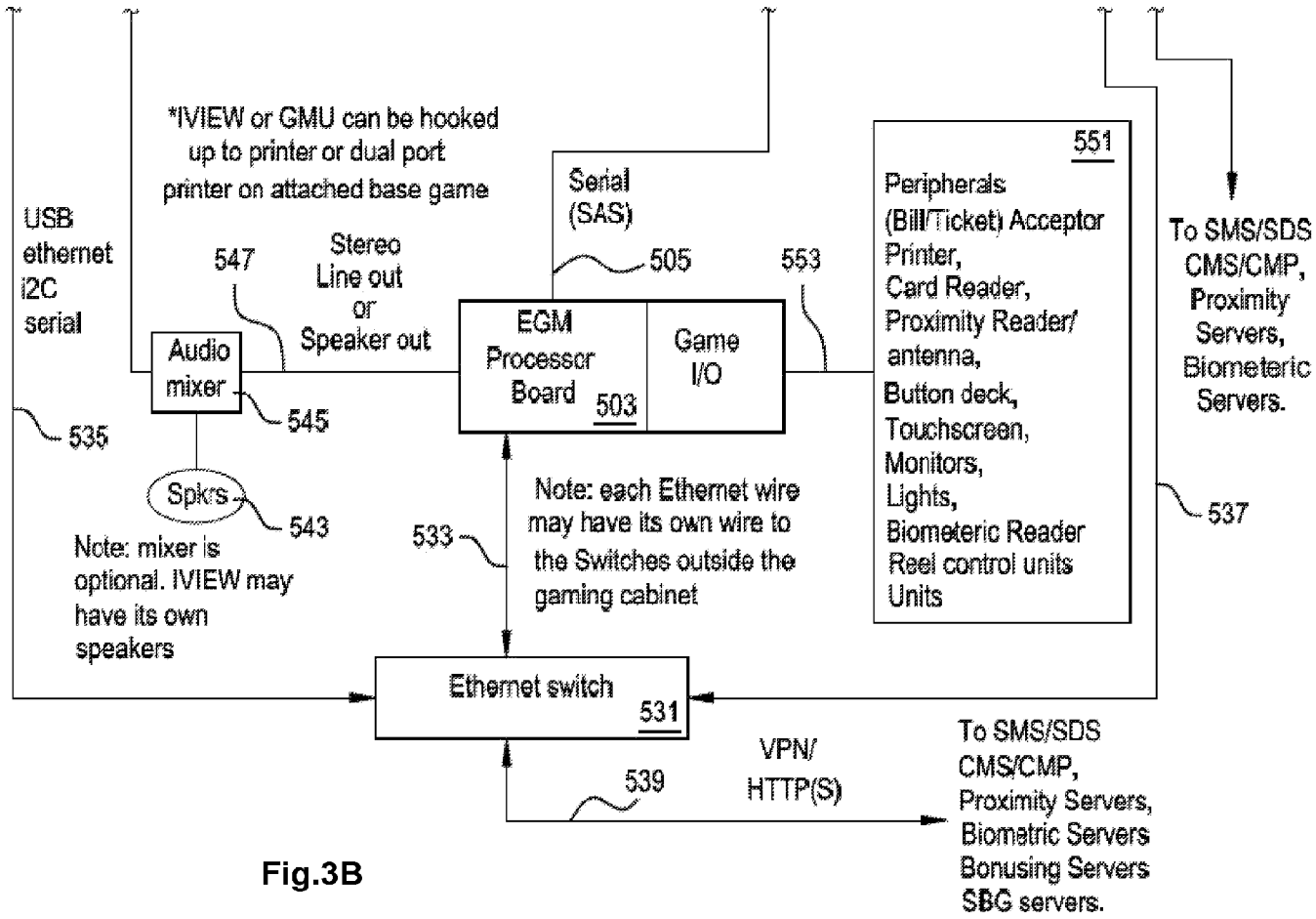

Referring to FIGS. 3A and 3B, EGM 110 is shown in more detail in accordance with one or more embodiments. EGM 110 includes EGM processor board 503 (EGM Processor Board) connected through serial bus line 505 to game monitoring unit (GMU) 507 (such as a Bally MC300 or ACSC NT), and player interface integrated circuit board (PIB) 509 connected to player interface devices 511 over bus lines 513, 515, 517, 519, 521, 523. Printer 525 is connected to PIB 509 and GMU 507 over bus lines 527, 529. EGM processor board 503, PIB 509, and GMU 507 connect to Ethernet switch 531 over bus lines 533, 535, 537. Ethernet switch 531 connects to a slot management system (SMS) and a casino management system (CMS) network over bus line 539. GMU 507 also may connect to the SMS and CMS network over bus line 541. Speakers 543 connect through audio mixer 545 and bus lines 547, 549 to EGM processor board 503 and PIB 509. The proximity and biometric devices and circuitry may be installed by upgrading a commercially available PIB 509, such as a Bally iView unit. Coding executed on EGM processor board 503, PIB 509, and/or GMU 507 condition the EGM 110 to operate a wagering game in response to wagers by a player.

Coding executed on the EGM processor board 503 allocates storage for EGM configuration options. Those options are accessed to determine how the EGM 110 operates, such as what game theme is displayed, the denominations available to the player, the paytable to be used, etc. This coding also enables receiving requests for configuration options from the progressive controller 100 for data representing the EGM configuration options, and enables responding to such requests by sending that data to the progressive controller using the Ethernet switch 531. This coding further enables the EGM to participate in a progressive jackpot award game.

Peripherals 551 connect through bus line 553 to EGM processor board 503. For example, a bill/ticket acceptor is typically connected to a game input-output board 553 which is, in turn, connected to a conventional central processing unit ("CPU") EGM processor board 503, such as an Intel Pentium microprocessor mounted on a gaming motherboard. I/O board 553 may be connected to EGM processor board 503 by a serial connection such as RS-232 or USB or may be attached to the processor by a bus such as, but not limited to, an ISA bus. The gaming motherboard may be mounted with other conventional components, such as are found on conventional personal computer motherboards, and loaded with a game program which may include an EGM operating system (OS), such as a Bally Alpha OS EGM processor board 503 executes a game program that causes EGM processor board 503 to play a game. The various components and included devices may be installed with conventionally and/or commercially available components, devices, and circuitry into a conventionally- and/or commercially available EGM cabinet, examples of which are described above.

When a player has inserted a form of currency such as, for example and without limitation, paper currency, coins or tokens, cashless tickets or vouchers, electronic funds transfers or the like into the currency acceptor, a signal is sent by way of I/O board 553 to EGM processor board 503 which, in turn, assigns an appropriate number of credits for play in accordance with the game program. The player(s) may further control the operation of the EGM by way of other peripherals 551, for example, to select the amount to wager via electromechanical or touch screen buttons. The game starts in response to a player operating a start mechanism such as a handle or touch screen icon. The game program includes a random number generator to provide a display of randomly selected indicia on one or more displays. In some embodiments, the random generator may be physically separate from EGM 400; for example, it may be part of a central determination host system which provides random game outcomes to the game program. Thereafter, the players may or may not interact with the game through electromechanical or touch screen buttons to change the displayed indicia. Finally, EGM processor board 503 under control of the game program and OS compares the final display of indicia to a pay table. The set of possible game outcomes may include a subset of outcomes related to the triggering of a feature game. In the event the displayed outcome is a member of this subset, EGM processor board 503, under control of the game program and by way of I/O Board 553, may cause feature game play to be presented on a feature display.

Predetermined payout amounts for certain outcomes, including feature game outcomes, are stored as part of the game program. Such payout amounts are, in response to instructions from EGM processor board 503, provided to the player in the form of coins, credits or currency via I/O board 553 and a pay mechanism, which may be one or more of a credit meter, a coin hopper, a voucher printer, an electronic funds transfer protocol or any other payout means known or developed in the art.

In various embodiments, the game program is stored in a memory device (not shown) connected to or mounted on the gaming motherboard. Further, data representing the configuration options is also stored in the memory device. By way of example, but not by limitation, such memory devices include external memory devices, hard drives, CD-ROMs, DVDs, and flash memory cards. In an alternative embodiment, the game programs are stored in a remote storage device. In one embodiment, the remote storage device is housed in a remote server. The EGM may access the remote storage device via a network connection, including but not limited to, a local area network connection, a TCP/IP connection, a wireless connection, or any other means for operatively networking components together. Optionally, other data including graphics, sound files and other media data for use with the EGM are stored in the same or a separate memory device (not shown). Some or all of the game program and its associated data may be loaded from one memory device into another, for example, from flash memory to random access memory (RAM).

In one or more embodiments, peripherals may be connected to the system over Ethernet connections directly to the appropriate server or tied to the system controller inside the EGM using USB, serial or Ethernet connections. Each of the respective devices may have upgrades to their firmware utilizing these connections.

GMU 507 includes an integrated circuit board and GMU processor and memory including coding for network communications, such as the G2S (game-to-system) protocol from the Gaming Standards Association, Las Vegas, Nev., or the MML protocol developed by Bally Technology, used for system communications over the network. As shown, GMU 507 may connect to card reader 555 through bus 557 and may thereby obtain player card information and transmit the information over the network through bus line 541. Gaming activity information may be transferred by the EGM processor board 503 to GMU 507 where the information may be translated into a network protocol, such as S2S, for transmission to a server, such as a player tracking server, where information about a player's playing activity may be stored in a designated server database.

PIB 509 includes an integrated circuit board, PID processor, and memory which includes an operating system, such as Windows CE, a player interface program which may be executable by the PID processor together with various input/output (I/O) drivers for respective devices which connect to PIB 509, such as player interface devices 511, and which may further include various games or game components playable on PIB 509 or playable on a connected network server and PIB 509 is operable as the player interface. PIB 509 connects to card reader 555 through bus line 523, display 559 through video decoder 561 and bus line 521, such as an LVDS or VGA bus.

As part of its programming, the PID processor executes coding to drive display 559 and provide messages and information to the players. Touch screen circuitry interactively connects display 559 and video decoder 561 to PIB 509 such that a player may input information and cause the information to be transmitted to PIB 509 either on the player's initiative or responsive to a query by PIB 509. Additionally soft keys 565 connect through bus line 517 to PIB 509 and operate together with display 559 to provide information or queries to a player and receive responses or queries from the player. PIB 509, in turn, communicates over the CMS/SMS network through Ethernet switch 531 and bus lines 535, 539 and with respective servers, such as a player tracking server.

Player interface devices 511 are linked into the virtual private network of the system components in EGM 110. The system components include the iVIEW processing board and game monitoring unit (GMU) processing board. These system components may connect over a network to the slot management system (such as a commercially available Bally SDS/SMS) and/or casino management system (such as a commercially available Bally CMP/CMS).

The GMU system component has a connection to the base game through a serial SAS connection and is connected to various servers using, for example, HTTPs over Ethernet. Through this connection, firmware, media, operating system software, EGM configuration options can be downloaded to the system components from the servers. This data is authenticated prior to install on the system components.

The system components include the iVIEW processing board and game monitoring unit (GMU) processing board. The GMU and iVIEW can combined into one like the commercially available Bally GTM iVIEW device. This device may have a video mixing technology to mix the EGM processor's video signals with the iVIEW display onto the top box monitor or any monitor on the gaming device.

Figure 4:
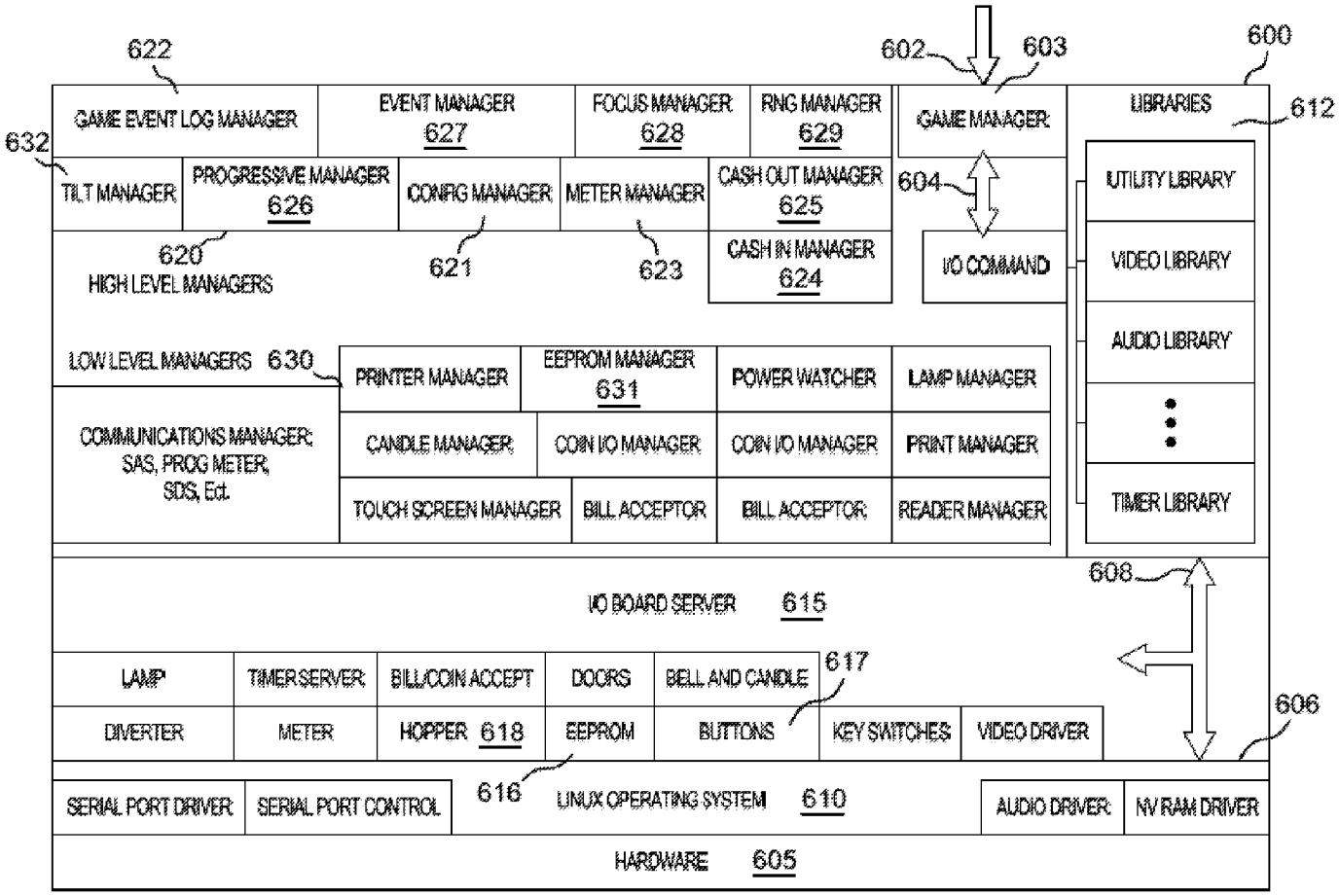
FIG. 4 is a functional diagram of an operating system which may be used in the EGM illustrated in FIGS. 3A and B according to principles of the present invention.

In accordance with one or more embodiments, FIG. 4 is a functional block diagram of a gaming kernel 600 of a game program under control of EGM processor board 503 (FIG. 3A). The game program uses gaming kernel 600 by calling into application programming interface (API) 602, which is part of game manager 603. The components of game kernel 600 as shown in FIG. 4 are only illustrative, and should not be considered limiting. For example, the number of managers may be changed, additional managers may be added or some managers may be removed without deviating from the scope and spirit of the invention.

As shown in the example, there are three layers: a hardware layer 605; an operating system layer 610, such as, but not limited to, Linux; and a game kernel layer 600 having game manager 603 therein. In one or more embodiments, the use of a operating system layer 610, such a UNIX-based or Windows-based operating system, allows game developers interfacing to the gaming kernel to use any of a number of standard development tools and environments available for the operating systems. This is in contrast to the use of proprietary, low level interfaces which may require significant time and engineering investments for each game upgrade, hardware upgrade, or feature upgrade. The game kernel layer 600 executes at the user level of the operating system layer 610, and itself contains a major component called the I/O board server 615. To properly set the bounds of game application software (making integrity checking easier), all game applications interact with gaming kernel 600 using a single API 602 in game manager 603. This enables game applications to make use of a well-defined, consistent interface, as well as making access points to gaming kernel 600 controlled, where overall access is controlled using separate processes.

For example, game manager 603 parses an incoming command stream and, when a command dealing with I/O comes in (arrow 604), the command is sent to an applicable library routine 612. Library routine 612 decides what it needs from a device, and sends commands to I/O board server 615 (see arrow 608). A few specific drivers remain in operating system layer 610's kernel, shown as those below line 606. These are built-in, primitive, or privileged drivers that are (i) general (ii) kept to a minimum and (iii) are easier to leave than extract. In such cases, the low-level communications is handled within operating system layer 610 and the contents passed to library routines 612.

Thus, in a few cases library routines may interact with drivers inside operating system layer 610, which is why arrow 608 is shown as having three directions (between library routines 612 and I/O board server 615, or between library routines 612 and certain drivers in operating system layer 610). No matter which path is taken, the logic needed to work with each device is coded into modules in the user layer of the diagram. Operating system layer 610 is kept as simple, stripped down, and common across as many hardware platforms as possible. The library utilities and user-level drivers change as dictated by the game cabinet or game machine in which it will run. Thus, each game cabinet or game machine may have an industry standard processor board 503 (FIG. 3A) connected to a unique, relatively dumb, and as inexpensive as possible I/O adapter board 540, plus a gaming kernel 600 which will have the game-machine-unique library routines and I/O board server 615 components needed to enable game applications to interact with the EGM cabinet. Note that these differences are invisible to the game application software with the exception of certain functional differences (i.e., if a gaming cabinet has stereo sound, the game application will be able make use of API 602 to use the capability over that of a cabinet having traditional monaural sound).

Game manager 603 provides an interface into game kernel 600, providing consistent, predictable, and backwards compatible calling methods, syntax, and capabilities by way of game application API 602. This enables the game developer to be free of dealing directly with the hardware, including the freedom to not have to deal with low-level drivers as well as the freedom to not have to program lower level managers 630, although lower level managers 630 may be accessible through game manager 603's interface 602 if a programmer has the need. In addition to the freedom derived from not having to deal with the hardware level drivers and the freedom of having consistent, callable, object-oriented interfaces to software managers of those components (drivers), game manager 603 provides access to a set of upper level managers 620 also having the advantages of consistent callable, object-oriented interfaces, and further providing the types and kinds of base functionality required in casino-type games. Game manager 603, providing all the advantages of its consistent and richly functional interface 602 as supported by the rest of game kernel 600, thus provides a game developer with a multitude of advantages.

Game manager 603 may have several objects within itself, including an initialization object (not shown). The initialization object performs the initialization of the entire game machine, including other objects, after game manager 603 has started its internal objects and servers in appropriate order. In order to carry out this function, the kernel's configuration manager 621 is among the first objects to be started; configuration manager 621 accesses configuration option representative data 112 (FIG. 1) needed to initialize and correctly configure other objects or servers.

The upper level managers 620 of game kernel 600 may include game event log manager 622 which provides, at the least, a logging or logger base class, enabling other logging objects to be derived from this base object. The logger object is a generic logger; that is, it is not aware of the contents of logged messages and events. The game event log manager's (622) job is to log events in non-volatile event log space. The size of the space may be fixed, although the size of the logged event is typically not. When the event space or log space fills up, one embodiment will delete the oldest logged event (each logged event will have a time/date stamp, as well as other needed information such as length), providing space to record the new event. In this embodiment, the most recent events will thus be found in the log space, regardless of their relative importance. Further provided is the capability to read the stored logs for event review.

In accordance with one embodiment, meter manager 623 manages the various meters embodied in the game kernel 600. This includes the accounting information for the game machine and game play. There are hard meters (counters) and soft meters; the soft meters may be stored in non-volatile storage such as non-volatile battery-backed RAM to prevent loss. Further, a backup copy of the soft meters may be stored in a separate non-volatile storage such as EEPROM. In one embodiment, meter manager 623 receives its initialization data for the meters, during startup, from configuration manager 621. While running, the cash in (624) and cash out (625) managers call the meter manager's (623) update functions to update the meters. Meter manager 623 will, on occasion, create backup copies of the soft meters by storing the soft meters' readings in EEPROM. This is accomplished by calling and using EEPROM manager 631.

In accordance with still other embodiments, progressive manager 626 manages progressive jackpot award games playable from the game machine. The progressive manager accesses the EGM configuration option data 114 (FIG. 1) related to the operation of the EGM 110 in the progressive jackpot award game. Event manager 627 is generic, like game event log manager 622, and is used to manage various EGM events. Focus manager 628 correlates which process has control of various focus items. Tilt manager 632 is an object that receives a list of errors (if any) from configuration manager 621 at initialization, and during game play from processes, managers, drivers, etc. that may generate errors. Random number generator manager 629 is provided to allow easy programming access to a random number generator (RNG), as a RNG is required in virtually all casino-style (gambling) games. Random number generator manager 629 includes the capability of using multiple seeds.

In accordance with one or more embodiments, a credit manager object (not shown) manages the current state of credits (cash value or cash equivalent) in the game machine, including any available winnings, and further provides denomination conversion services. Cash out manager 625 has the responsibility of configuring and managing monetary output devices. During initialization, cash out manager 625, using data from configuration manager 621, sets the cash out devices correctly and selects any selectable cash out denominations. During play, a game application may post a cash out event through the event manager 627 (the same way all events are handled), and using a callback posted by cash out manager 625, cash out manager 625 is informed of the event. Cash out manager 625 updates the credit object, updates its state in non-volatile memory, and sends an appropriate control message to the device manager that corresponds to the dispensing device. As the device dispenses dispensable media, there will typically be event messages being sent back and forth between the device and cash out manager 625 until the dispensing finishes, after which cash out manager 625, having updated the credit manager and any other game state (such as some associated with meter manager 623) that needs to be updated for this set of actions, sends a cash out completion event to event manager 627 and to the game application thereby. Cash in manager 624 functions similarly to cash out manager 625, only controlling, interfacing with, and taking care of actions associated with cashing in events, cash in devices, and associated meters and crediting.

In a further example, in accordance with one or more embodiments, I/O board server 615 may write data to the EGM EEPROM memory, which is located in the EGM cabinet and holds meter storage that must be kept even in the event of power failure. Game manager 603 calls the I/O library functions to write data to the EEPROM. The I/O board server 615 receives the request and starts a low priority EEPROM thread 616 within I/O board server 615 to write the data. This thread uses a sequence of 8 bit command and data writes to the EEPROM device to write the appropriate data in the proper location within the device. Any errors detected will be sent as inter-process communication (IPC) messages to game manager 603. All of this processing is asynchronous.

In accordance with one embodiment, button module 617 within I/O board server 615, polls (or is sent) the state of buttons every 2 milliseconds. These inputs are debounced by keeping a history of input samples. Certain sequences of samples are required to detect a button was pressed, in which case the I/O board server 615 sends an IPC message to game manager 603 that a button was pressed or released. In some embodiments, the EGM may have intelligent distributed I/O which debounces the buttons, in which case button module 617 may be able to communicate with the remote intelligent button processor to get the button events and simply relay them to game manager 603 via IPC messages. In still another embodiment, the I/O library may be used for pay out requests from the game application. For example, hopper module 618 must start the hopper motor, constantly monitor the coin sensing lines of the hopper, debounce them, and send an IPC message to the game manager 603 when each coin is paid.

Further details, including disclosure of lower level fault handling and/or processing, are included in U.S. Pat. No. 7,351,151 entitled "Gaming Board Set and Gaming Kernel for Game Cabinets" and provisional U.S. patent application No. 60/313,743, entitled "Form Fitting Upgrade Board Set For Existing Game Cabinets," filed Aug. 20, 2001; said patent and provisional are both fully incorporated herein by explicit reference.

Figure 5A:
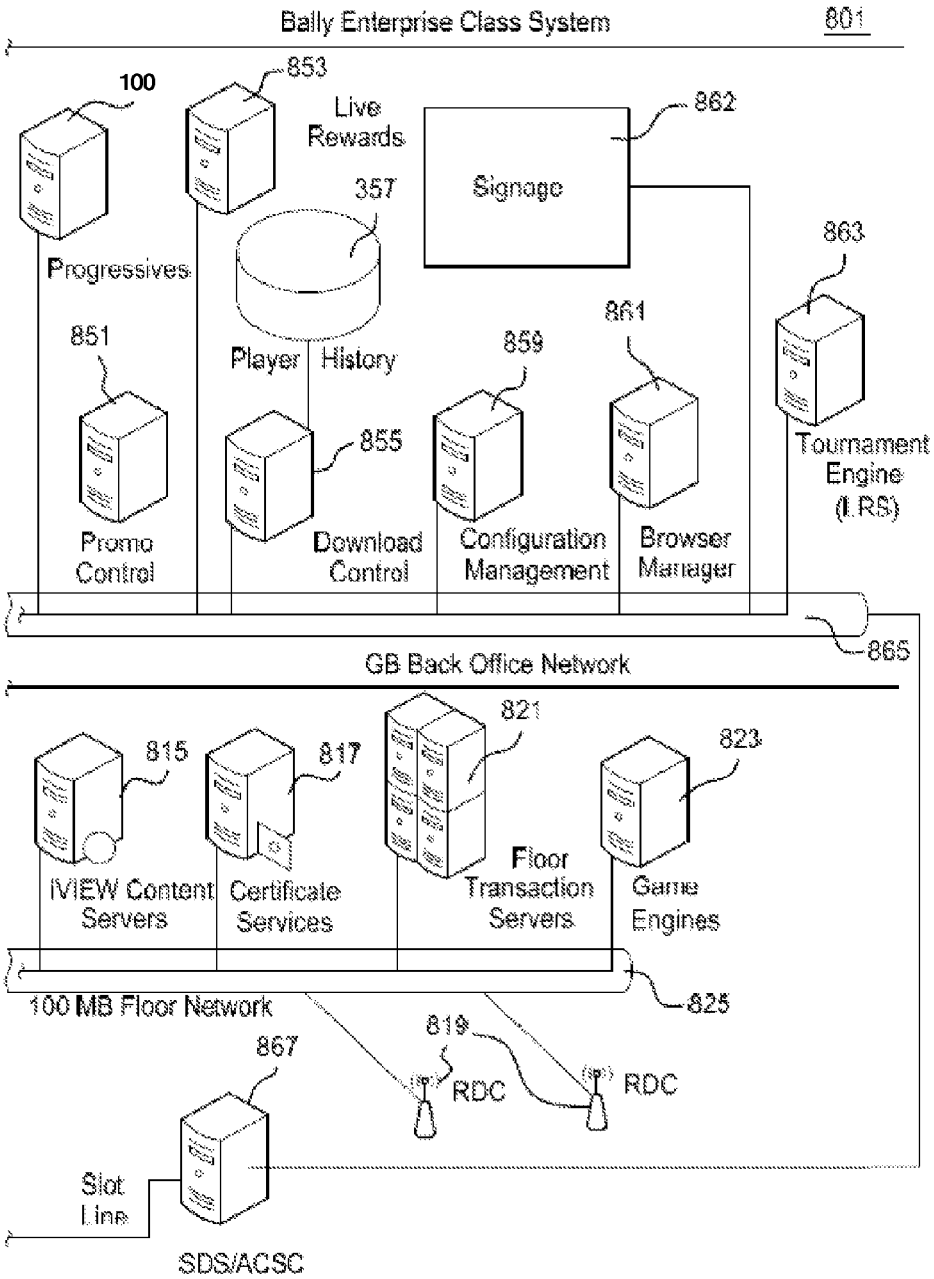
FIGS. 5A and B are block diagrams of a networked enterprise gaming system according to principles of the present invention.
Figure 5B:
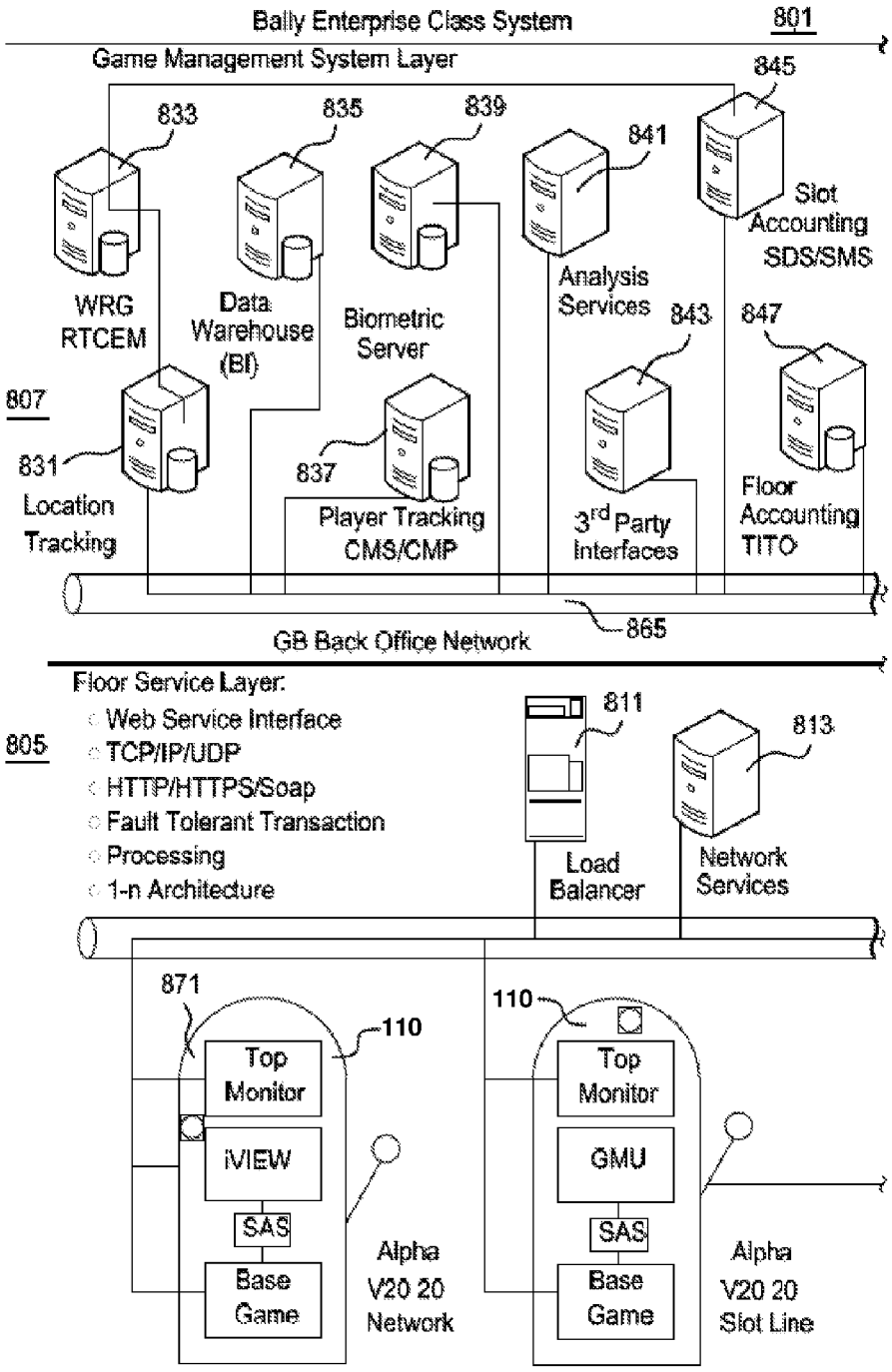

Referring to FIGS. 5A and B, enterprise gaming system 801 is shown in accordance with one or more embodiments. Enterprise gaming system 801 may include one casino or multiple locations and generally includes a network of EGMs 110, floor management system (SMS) 805, and casino management system (CMS) 807. SMS 805 may include load balancer 811, network services servers 813, player interface (iVIEW) content servers 815, certificate services server 817, floor radio dispatch receiver/transmitters (RDC) 819, floor transaction servers 821 and game engines 823, each of which may connect over network bus 825 to EGMs 110. CMS 807 may include location tracking server 831, WRG RTCEM server 833, data warehouse server 835, player tracking server 837, biometric server 839, analysis services server 841, third party interface server 843, slot accounting server 845, floor accounting server 847, progressives controller 100, promo control server 851, bonus game (such as Bally Live Rewards) server 853, download control server 855, player history database 857, configuration management server 859, browser manager 861, tournament engine server 863 connecting through bus 865 to server host 867 and EGMs 110.

One skilled in the art understands that more than one server may be provided in the enterprise gaming system 801 to provide the services described above. For example, more than one progressive controller 100 (not shown to simplify the figure) may be provided. The EGMs 110, in turn, are coupled to each of the progressive controllers 100. In such an arrangement, the EGMs 110 may be configured to participate in progressive jackpot award games controlled by any of the progressive controllers 100, and the progressive controllers 100 may operate a progressive jackpot award game in which any of the EGMs 110 may participate.

The various servers and EGMs 110 may connect to the network with various conventional network connections (such as, for example, USB, serial, parallel, RS485, Ethernet). Additional servers which may be incorporated with CMS 807 include a responsible gaming limit server (not shown), advertisement server (not shown), and a control station server (not shown) where an operator or authorized personnel may select options and input new programming to adjust each of the respective servers and EGMs 110, as described above. SMS 805 may also have additional servers including a control station (not shown) through which authorized personnel may select options, modify programming, and obtain reports of the connected servers and devices, and obtain reports. The various CMS and SMS servers are descriptively entitled to reflect the functional executable programming stored thereon and the nature of databases maintained and utilized in performing their respective functions.

EGMs 110 include various peripheral components that may be connected with USB, serial, parallel, RS-485 or Ethernet devices/architectures to the system components within the respective EGM 110. The GMU has a connection to the base game through a serial SAS connection. The system components in the gaming cabinet may be connected to the servers using HTTPs or G2S over Ethernet. Using CMS 807 and/or SMS 805 servers and devices, firmware, media, operating systems, and configurations may be downloaded to the system components of respective EGMs 110 for upgrading or managing floor content and offerings in accordance with operator selections or automatically depending upon CMS 807 and SMS 805 master programming. The data and programming updates to EGMs 110 are authenticated using conventional techniques prior to install on the system components.

In various embodiments, any of the EGMs 110 may be a mechanical reel spinning slot machine, video slot machine, video poker machine, keno machine, video blackjack machine, or an EGM 110 offering one or more of the above described games. A gaming system of the type described above allows a plurality of games in accordance with the various embodiments of the invention to be linked under the control of a group game server (not shown) for cooperative or competitive play in a particular area, carousel, casino or between casinos located in geographically separate areas. For example, one or more examples of group games under control of a group game server are disclosed in U.S. application Ser. No. 11/938,079, entitled "Networked System and Method for Group Play Gaming," filed on Nov. 9, 2007, which is hereby incorporated by reference in its entirety for all purposes.

What is claimed is:

1. A progressive jackpot feature controller for a plurality of electronic devices each adapted for operating a wagering game selected from an available plurality game configuration options and each connected for communication over a network, said progressive jackpot feature controller comprising:

apparatus for said controller to communicate over said network with said devices;

a data structure storing data representing a plurality of progressive jackpot feature configuration options at least one of which is compatible with an available game configuration option for at least a subset of said devices;

said controller configured to send a message to said subset of devices to invoke said compatible game configuration option to link said subset of devices for a progressive award feature.

2. The progressive controller of claim 1 wherein a device is added to the network comprising said controller configured to send said message to said added device to invoke said compatible game configuration option to link said added device for said progressive jackpot feature if said added device includes said compatible game configuration option.

3. The progressive controller of claim 1 comprising said data structure stores data representing a second progressive jackpot feature which is compatible with a second subset of said available game configuration options, said controller configured to send a message to said second subset of devices to invoke said compatible game configuration option to link said second subset of devices for a second progressive jackpot feature.

4. A progressive jackpot feature controller for a plurality of electronic devices each adapted for operating a wagering game selected from an available plurality game configuration options and each connected for communication over a network, said progressive jackpot feature controller comprising:

apparatus for said controller to communicate over said network with said devices;

a data structure storing data representing a plurality of progressive jackpot feature configuration options at least one of which is compatible with an available game configuration option for at least a subset of said devices;

said controller configured to send a message to said devices to request game configuration options, to compare said game configuration options to said progressive jackpot feature configuration options to determine at least a subset of said devices where a game configuration option is compatible to a progressive jackpot feature configuration option and to link said subset of devices for said at least one progressive jackpot feature.

5. The progressive jackpot controller of claim 4 comprising said controller configured to detect a device of said subset operating under a game configuration option incompatible with said at least one progressive jackpot feature and to send a message to said gaming device operating under said incompatible game configuration option to cause said device to invoke said compatible game configuration option.

6. The progressive jackpot controller of claim 1 configured to issue an message to said devices not is said subset indicative of their exclusion from said progressive jackpot feature.

7. The progressive controller of claim 5 comprising said data structure storing data representing a second progressive jackpot feature, said controller configured to compare said game configuration options to said second progressive jackpot feature configuration options to determine at least a second subset of said devices where a second game configuration option is compatible to said second progressive jackpot feature configuration and to link said second subset of devices for said second progressive jackpot feature.

8. The progressive jackpot controller of claim 5 comprising said controller configured to detect a device of said second subset operating under a second game configuration option incompatible with said second progressive jackpot feature and to send a message to said gaming device operating under said incompatible game configuration option to cause said device to invoke said compatible second game configuration option.

9. The progressive jackpot controller of claim 5 configured to issue an message to said devices not is said subsets indicative of their exclusion from said progressive jackpot feature.

* * * * *